US007153019B2

(12) United States Patent
Kuo

(10) Patent No.: US 7,153,019 B2
(45) Date of Patent: Dec. 26, 2006

(54) STRUCTURE IMPROVEMENT FOR CHRISTMAS BULB SOCKET

(76) Inventor: Cheng-Ju Kuo, P. O. Box 96-405, Taipei 106 (TW)

( * ) Notice: Subject to any disclaimer, the term of this patent is extended or adjusted under 35 U.S.C. 154(b) by 145 days.

(21) Appl. No.: 10/945,895

(22) Filed: Sep. 22, 2004

(65) Prior Publication Data

US 2006/0062020 A1 Mar. 23, 2006

(51) Int. Cl.
*H01R 33/00* (2006.01)

(52) U.S. Cl. ..... 362/657; 362/654; 362/806; 439/619; 439/699.2

(58) Field of Classification Search ..... 362/227–252, 362/652–659, 806, 249; 313/318.01, 318.05, 313/318.09, 318.12; 439/375, 619, 699.2
See application file for complete search history.

(56) References Cited

U.S. PATENT DOCUMENTS 5,735,597 A * 4/1998 Weng ..... 362/267
6,043,593 A * 3/2000 Pan ..... 313/318.01
6,053,620 A * 4/2000 Won ..... 362/96
6,113,430 A * 9/2000 Wu ..... 439/619
6,142,646 A * 11/2000 Liu ..... 362/652

* cited by examiner

*Primary Examiner*—Ali Alavi
*Assistant Examiner*—Jason Moon Han
(74) *Attorney, Agent, or Firm*—Troxell Law Office, PLLC

(57) ABSTRACT

A structure improvement for Christmas bulb socket, which comprises a plurality of lamp assemblies; the lower part of the bulb socket is furnished with a cross-shaped plug stub and two sets of symmetrical cross-shaped through holes; after one set of the two copper wires of the bulb is plugged in different set of through holes, two different kinds of bulb assemblies can be formed; therefore, after the bulb assembly is plugged in a correct socket, no incompatible bulb assembly can be used in a lamp string.

5 Claims, 10 Drawing Sheets

STRUCTURE IMPROVEMENT FOR CHRISTMAS BULB SOCKET

BACKGROUND OF THE INVENTION

1. Field of the Invention

This invention relates to a Christmas lamp, and particularly to a structure for Christmas bulb socket, which can be used for mounting two different bulb assemblies.

2. Description of the Prior Art

In the conventional lamp strings for Christmas ornament, the ornament usually comprises an independent power-supply wire connected, in series, with a plurality of sockets, and the last socket on the tail end thereof is connected with an independent wire. Two independent power-supply wires are then twisted together to form into a lamp string; all the sockets in one lamp string are mounted with bulbs respectively so as to form into a lamp string for Christmas ornament.

A conventional flash-lamp string usually comprises a separate power-supply wire connected with a plurality of lamp sockets which are connected in series; the last lamp socket on the end of the string is connected with a separate power-supply wire; then, the two separate power-supply wires are twisted together to form into a lamp string; each socket is mounted with a bulb; the lamp string is used as a decoration; every lamp string is mounted with a thermal cut-out bulb so as to have the remaining bulbs turned on and off continuously, i.e., to provide a flash effect. A plurality of lamp strings can be connected in parallel, and twisted into an elongate lamp string.

A conventional flash-lamp string comprises a plurality of lamp sockets connected in series, and some of the lamp sockets are mounted with thermal cut-out bulbs so as to reduce the current flow in the lamp string; such a lamp string should not be connected with too many thermal cut-out bulbs so as to prevent from causing a danger of overheating.

Another conventional flash-lamp string, such as disclosed in U.S. Pat. No. 6,474,841, includes a plurality of different lamp strings in terms of shape and size; in that case, the regular flash bulb and the twinkle flash bulb can not be mounted in a non-compatible lamp socket. According to the embodiment of the aforesaid patent, the difference of shape and size can simply indicate the difference of the bulbs, i.e., a different bulb can not be mounted in a non-compatible lamp socket.

SUMMARY OF THE INVENTION

The prime object of the present invention is to provide a Christmas lamp string, in which each lamp assembly is furnished with a cross-shaped plug stub in the lower part thereof, and with two sets of symmetrical through holes; the two sets of symmetrical through holes facilitate two copper wires of a bulb to plug in two different through holes selected for different bulb assemblies; in other words, only the same type of bulb assembly and socket can be assembled together so as to prevent the incompatible bulb assembly and the socket from assembling together in a string.

Another object of the present invention is to provide a Christmas lamp string, in which the socket of each lamp assembly is furnished with two sets of cross-shaped copper-piece grooves, in which only one set is compatible to mount one set of copper pieces so as to facilitate the same type of bulb assembly to plug in; otherwise, the power supply would not be connected in case of a different type of bulb assembly being plugged in.

Still another object of the present invention is to provide a Christmas lamp string, in which each socket and each lamp assembly are furnished with at least one set of positioning grooves and one set of positioning flanges so as to facilitate different types of bulb assembly to plug in; otherwise, the copper pieces would be in contact electrically with the copper wires.

A further object of the present invention is to provide a Christmas lamp string, in which each socket and each lamp assembly are furnished with positioning grooves; when a different type of bulb assembly is plugged in the corresponding socket, the copper wires on both sides of the plug stub will be in close contact with the copper pieces on both sides of the rectangular cavity of the socket respectively so as to form into a string of lamp assembly.

Still a further object of the present invention is to provide a Christmas lamp string, in which a bulb assembly and a socket are assembled into a lamp assembly; then, a plurality of lamp assemblies is connected into a lamp string; in other words, two different types of lamp strings are connected with one main power-supply cable to form into a complex lamp string; the lamp string includes two different types of bulb assemblies by means of different plugging directions of the copper wires; after the two types of bulb assemblies are assembled together, the copper wires of the bulb and the copper pieces of the socket thereof are still in open-circuit condition without causing any danger.

DETAILED DESCRIPTION OF THE PREFERRED EMBODIMENT

Figure 1:
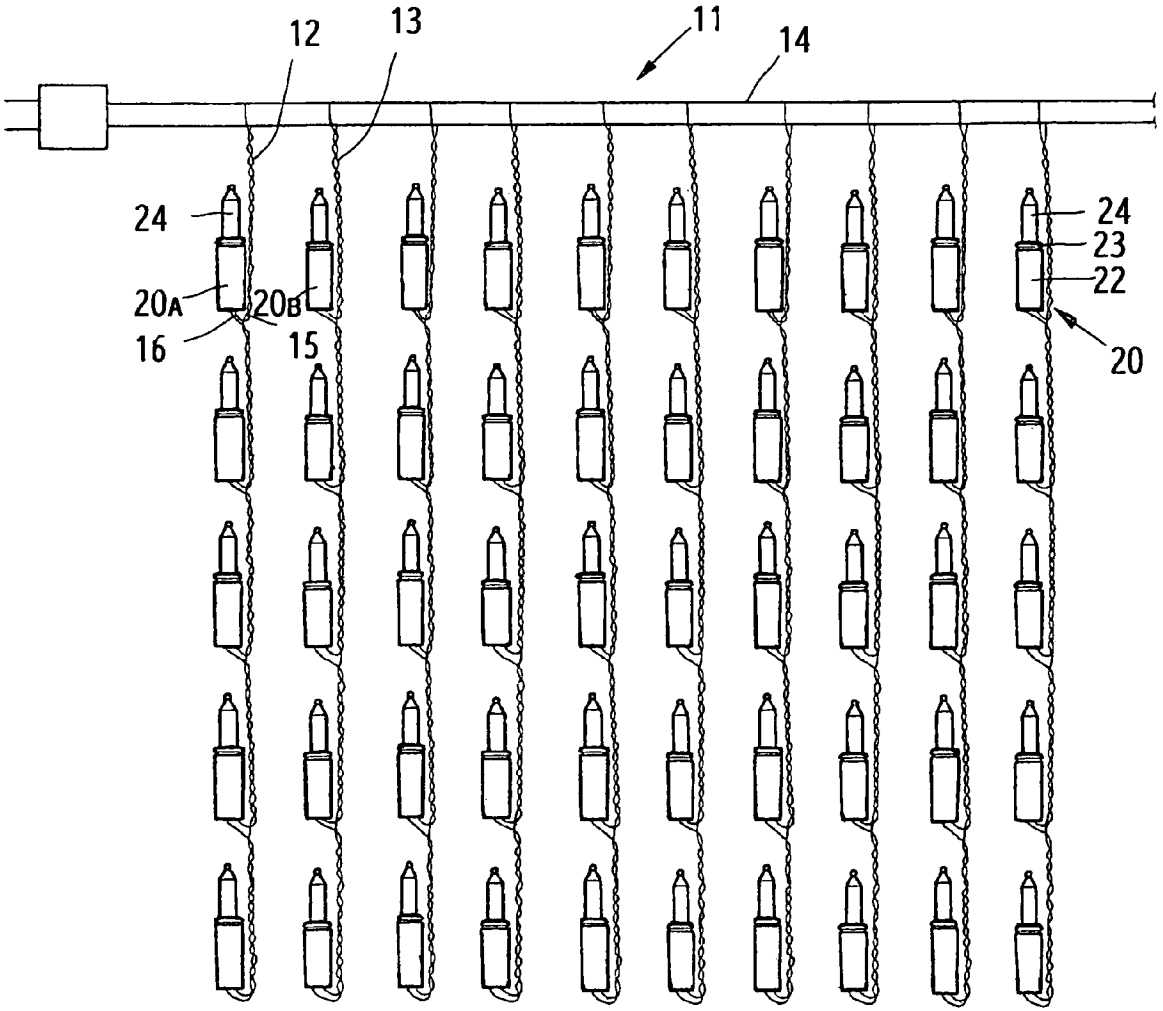
FIG. 1 is a plan view of the present invention, showing a plurality of lamp strings connected together.
Figure 2:
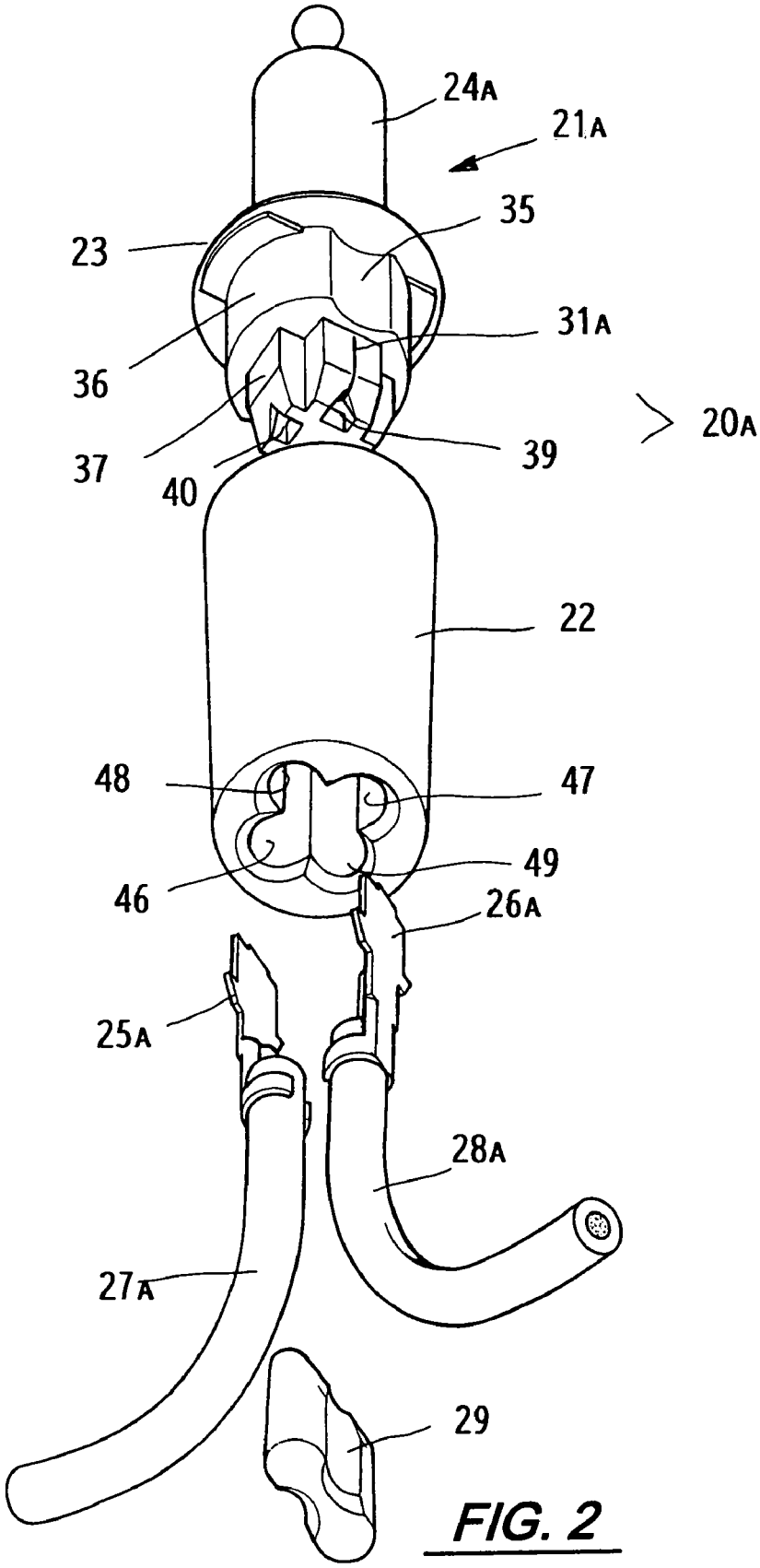
FIG. 2 is a disassembled view of the present invention, showing the structure of the first lamp assembly thereof.
Figure 3:
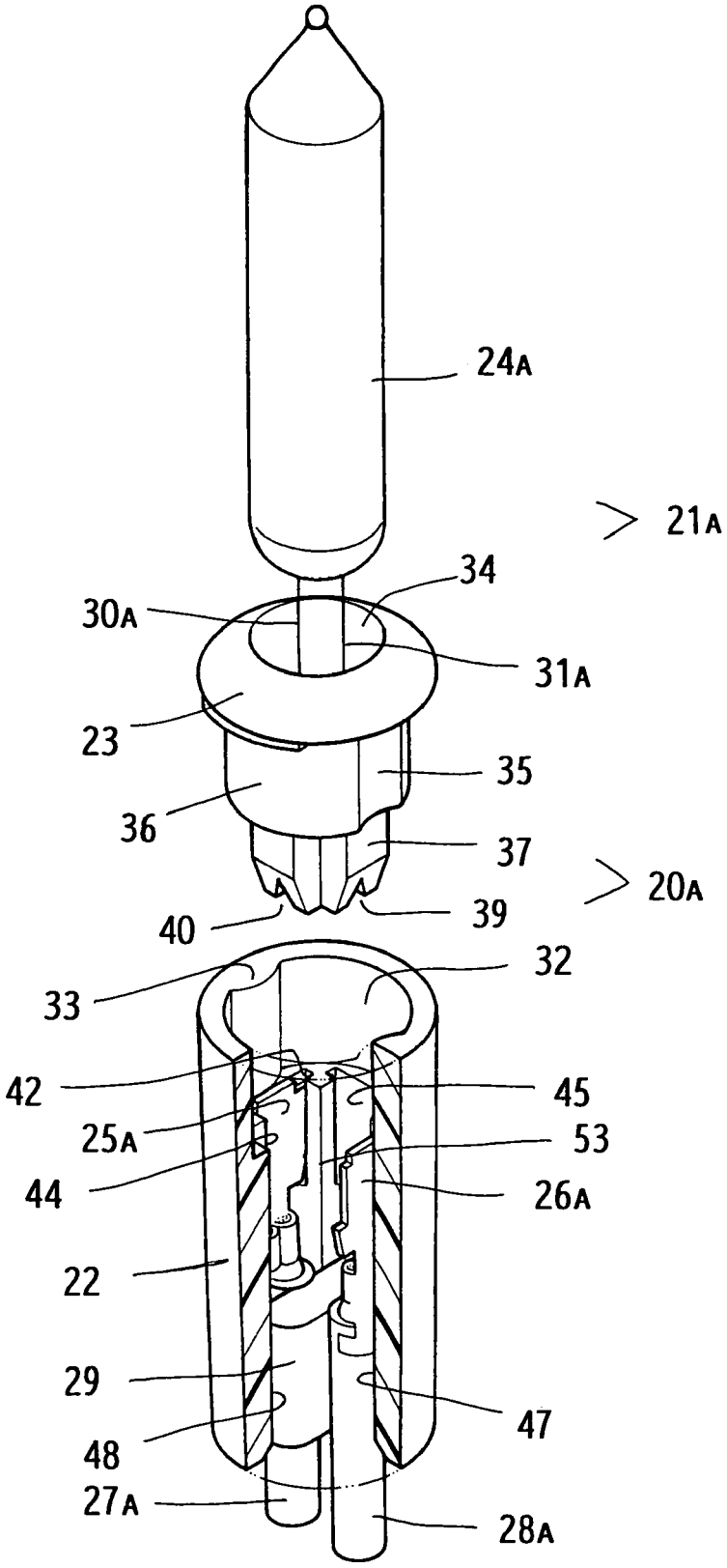
FIG. 3 is a disassembled view of the present invention, showing the structure of the second lamp assembly thereof.
Figure 4:
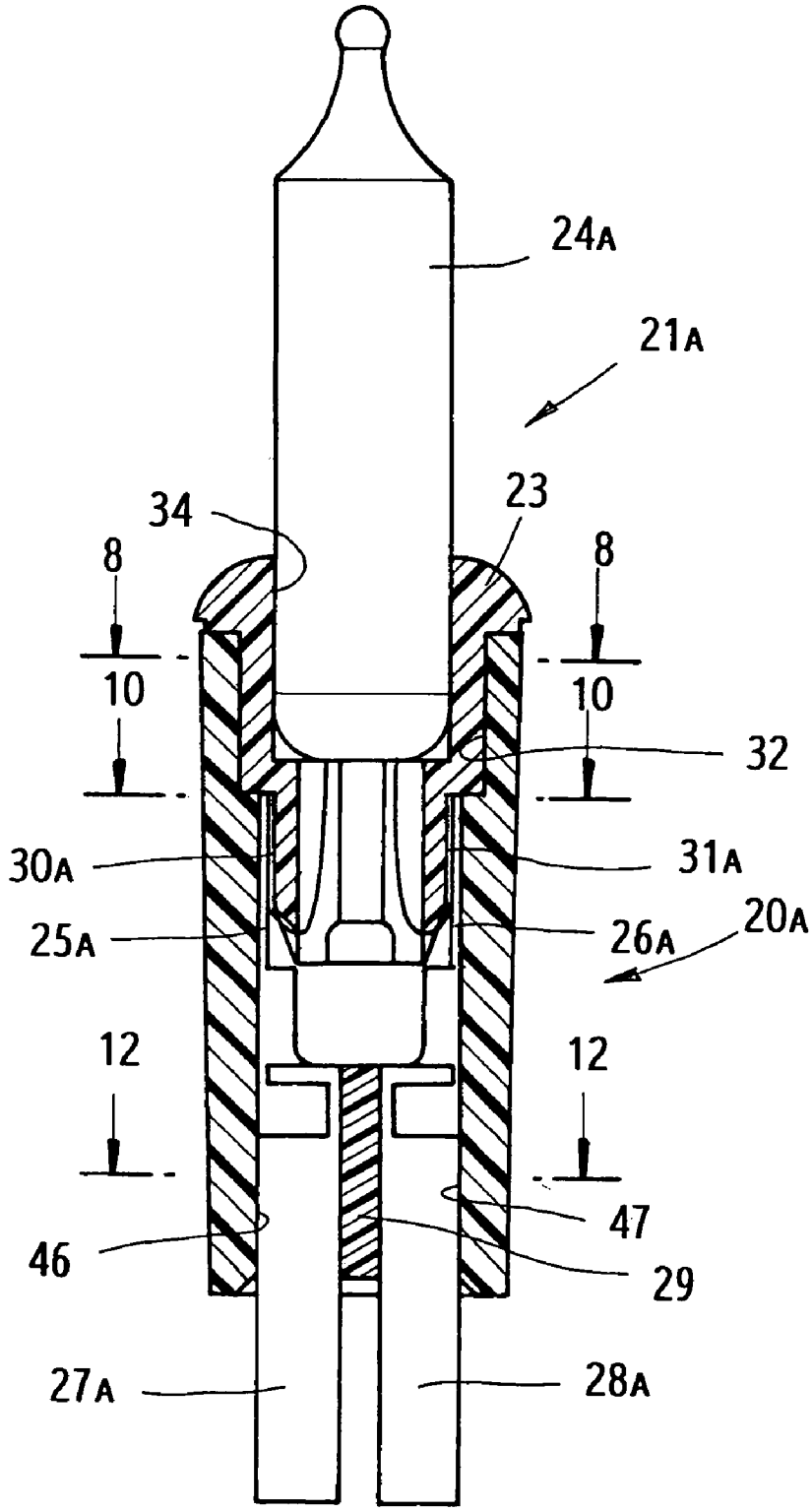
FIG. 4 is a sectional view of the present invention, showing the inner structure of the first lamp assembly thereof.
Figure 5:
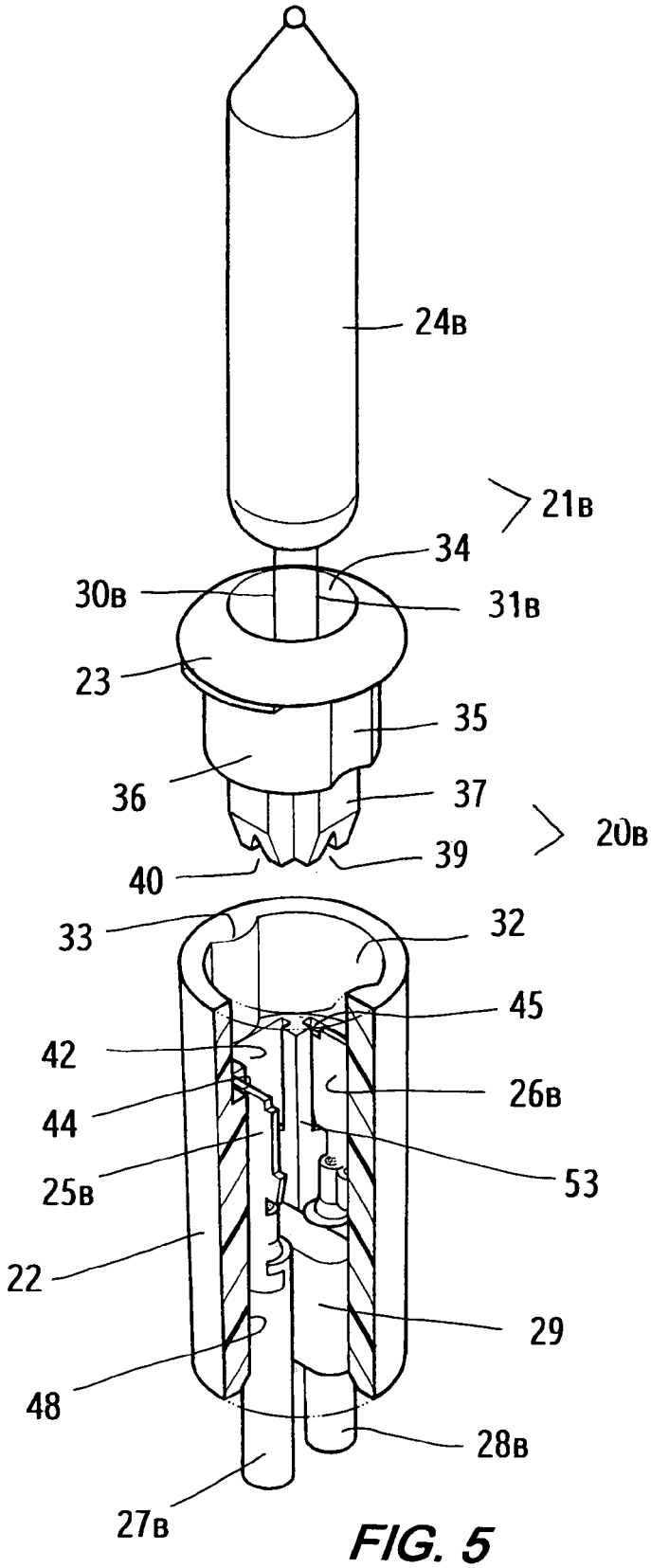
FIG. 5 is a disassembled view of the present invention, showing the structure of the second lamp assembly thereof.
Figure 6:
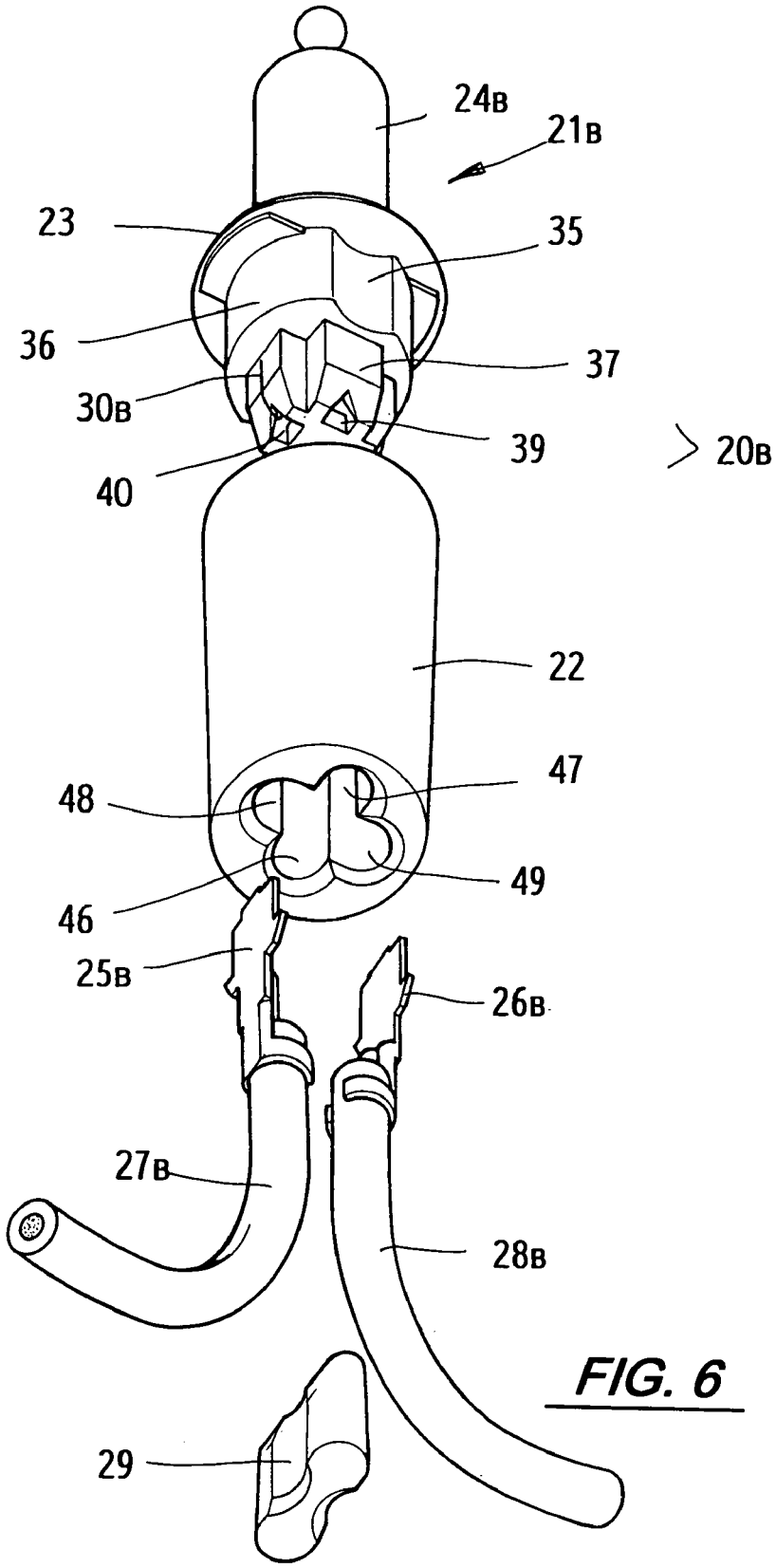
FIG. 6 is a disassembled view of the present invention, showing one side structure of the second lamp assembly thereof.
Figure 7:
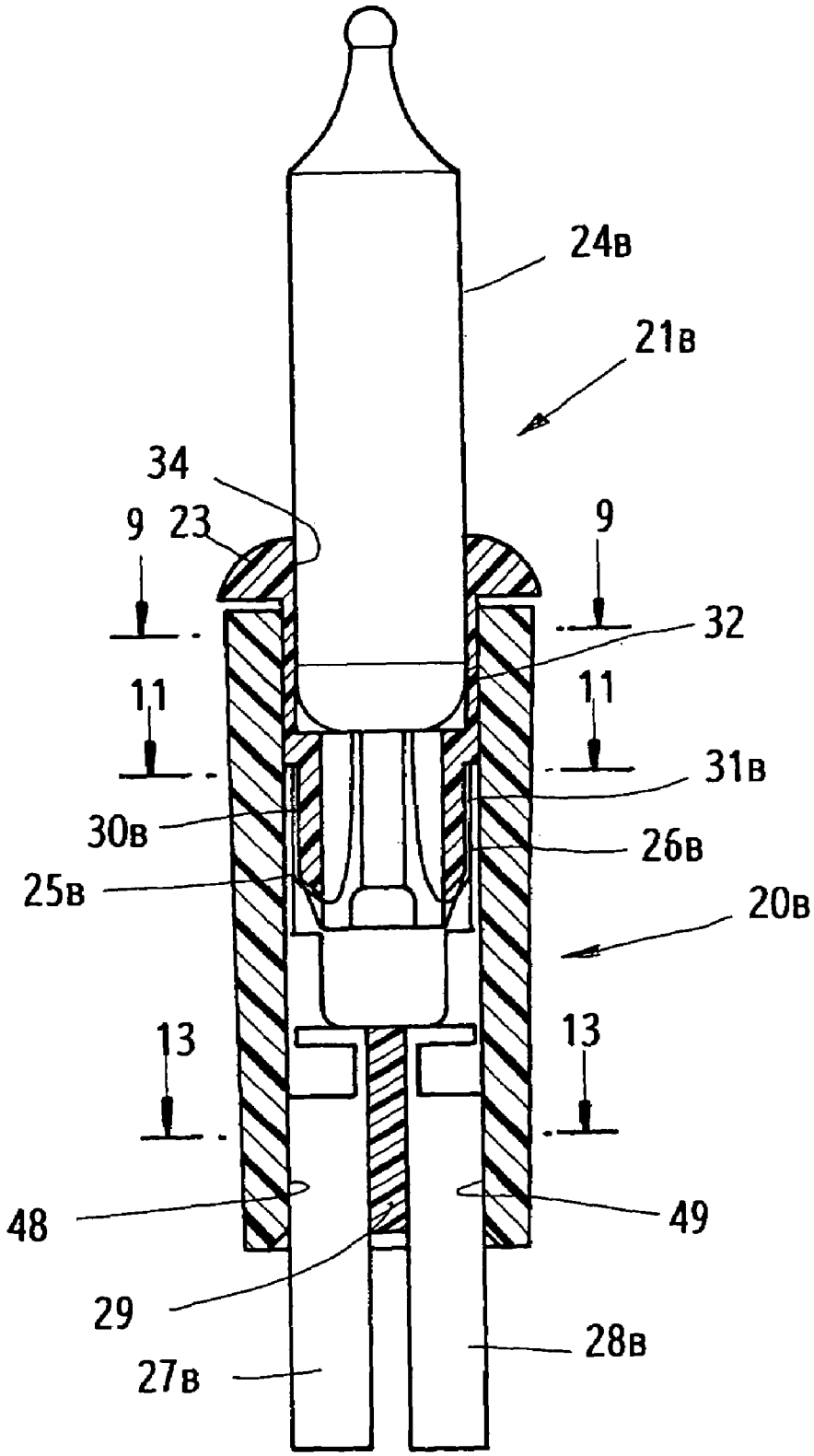
FIG. 7 is a sectional view of the present invention, showing the inner structure of the second lamp assembly thereof.
Figure 8:
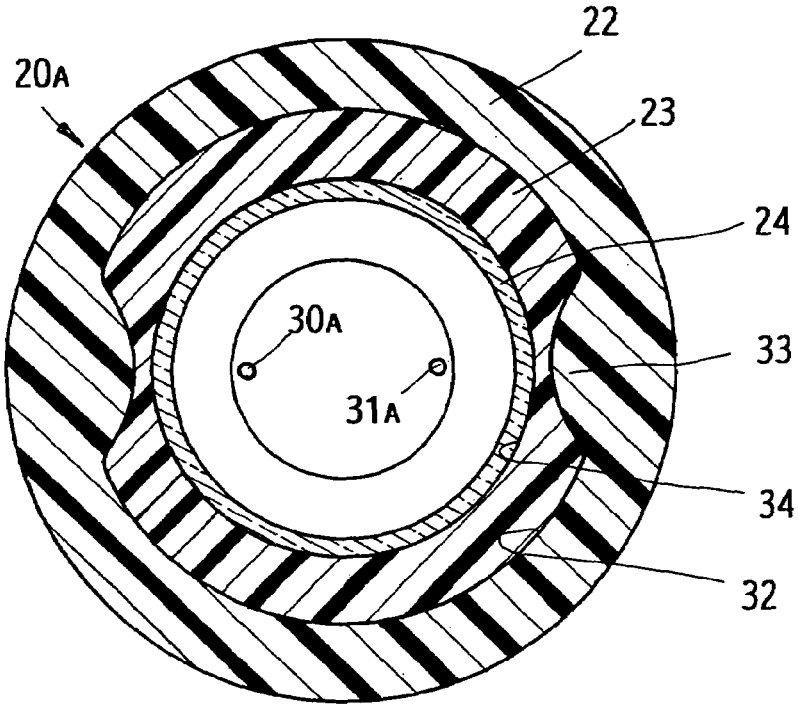
FIG. 8 is a sectional view of the present invention, showing the structure on line 8—8 in FIG. 4 thereof.
Figure 9:
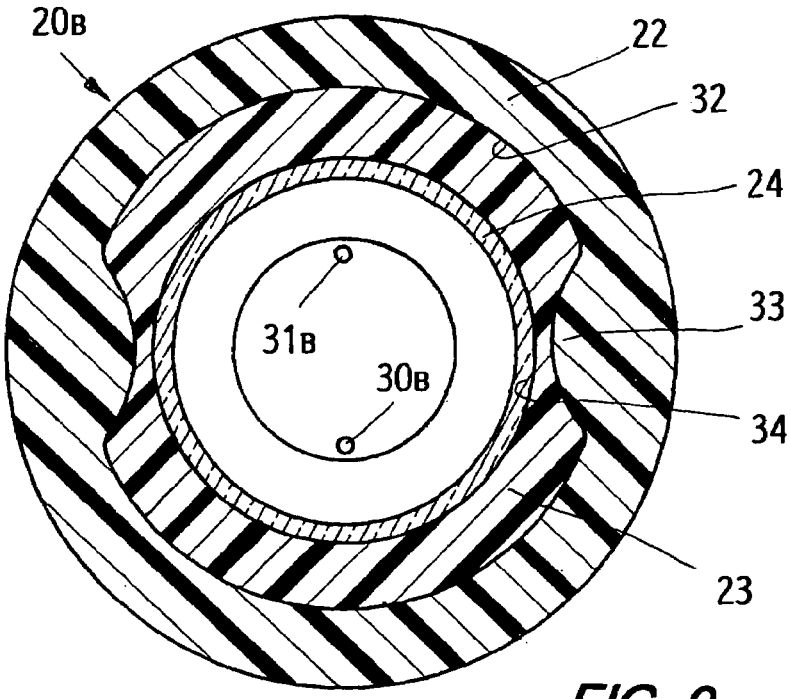
FIG. 9 is a sectional view of the present invention, showing the structure on line 9—9 in FIG. 7 thereof.

This invention relates to a structure improvement for a Christmas ornament lamp; as shown in FIG. 1, the Christmas lamp string 11 comprises a plurality of lamp strings 12 and 13, which are connected in parallel with a main power-supply cable 14; every lamp assembly 20 in the lamp strings 12 and 13 is designed in the same shape; two lamp assemblies 20 are connected in series with a short power-supply wire 16, and then they are connected to the main power-supply cable 14 with a long power-supply wire 15. The lamp strings 12 and 13 are twisted or connected in series to form into a long lamp string or other shape as desired.

As shown in FIGS. 2 to 4, 8, 10 and 12, each lamp assembly 20 includes a socket 22, a bulb socket 23, a bulb 24, two copper pieces 25 and 26, two power-supply wires 27 and 28, and a water-proof plug 29; the socket 22 is designed in a cone-shaped socket, which includes a cylindrical cavity 32, a rectangular groove 53 and a power-supply wire groove 47; the upper cylindrical cavity 32 is furnished with two symmetrical positioning flanges 33 to be mated with two symmetrical positioning grooves 35 on the socket 23 respectively so as to facilitate the bulb socket 23 to plug in the socket 22.

The rectangular cavity 53 in the lower part of the cylindrical cavity 32 is designed to mate with a cross-shaped plug stub 37, i.e., the cross-shaped plug stub 37 is to be plugged into the rectangular cavity 53 of the socket 22 upon the bulb socket 23 and the socket 22 being assembled together. Two symmetrical copper-piece grooves 42 and 43 are furnished on the horizontal level of the rectangular groove 53; another two symmetrical copper-piece grooves 44 and 45 are furnished on the vertical line of the rectangular cavity 53. Each socket 22 has two sets of copper-piece grooves, but only one set of copper pieces (i.e., two copper pieces 25 and 26) can be plugged therein; in other words, the rectangular cavity 53 in the socket 22 can facilitate two copper pieces 25 and 26 to plug in horizontal or vertical position; therefore, the bulb assembly 21 plugged in the socket 22 can be different.

Figure 10:
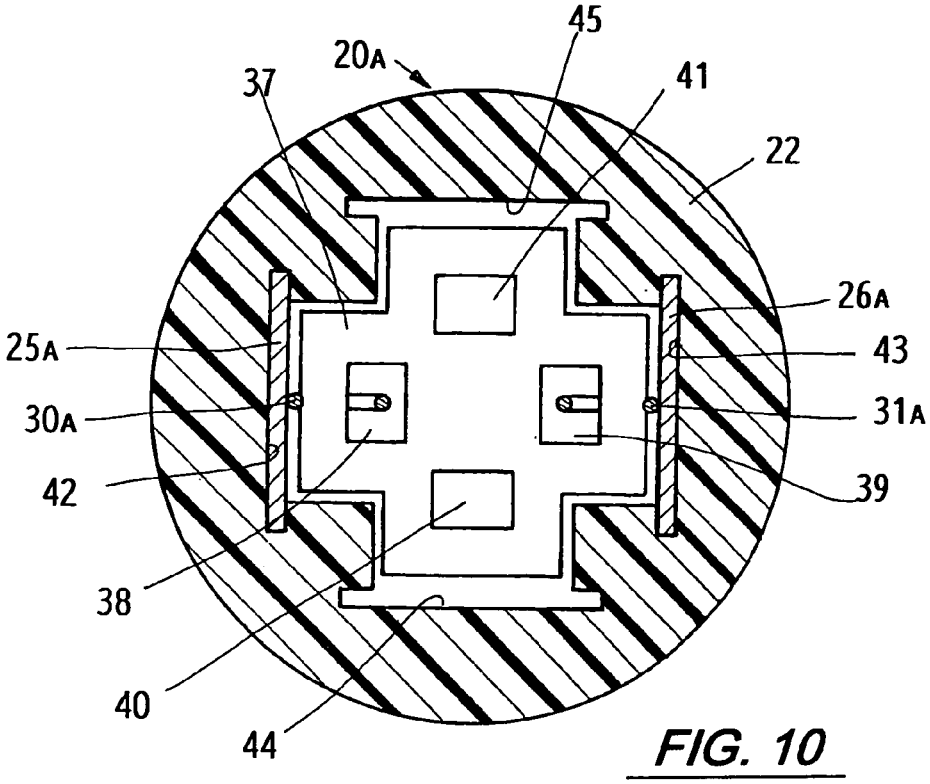
FIG. 10 is a sectional view of the present invention, showing the structure on line 0—0 in FIG. 4 thereof.
Figure 11:
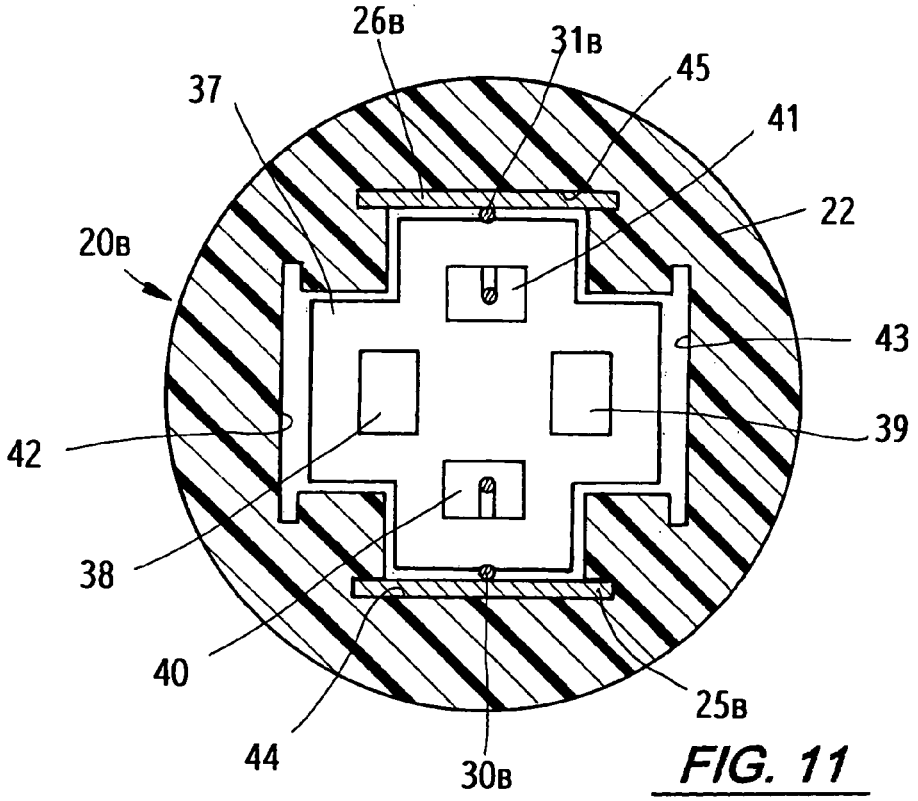
FIG. 11 is a sectional view of the present invention, showing the structure on line 1—1 in FIG. 7 thereof.

The two copper pieces 25 and 26 in the socket 22 are to be connected electrically with the terminals of two power-supply wires 27 and 28 respectively; the two copper pieces 25 and 26 are plugged into two symmetrical copper-piece grooves of the rectangular cavity 53 respectively. When the two copper pieces 25A and 26A are plugged in the horizontal level position in the rectangular cavity 53 of the socket 22 (as shown in FIG. 10), two power-supply wires 27A and 28A will be plugged into two power-supply wire grooves 46 and 47 in the rectangular cavity 53 respectively. The space between the two power-supply wires 27A and 28A is used for mounting a water-proof plug 29; after the water-proof plug 29 is plugged in place, it can prevent water from entering the socket 22. When the two copper piece 25B and 26B are plugged in the power-supply wire groove from the lower part of the socket 22 and in vertical position (as shown in FIG. 11), the two power-supply wires 27B and 28B will be mounted in the power supply wire grooves 48 and 49 in the lower part of the rectangular cavity 53 respectively so as to facilitate different bulb assembly 21B to plug in.

The bulb assembly 21 mounted in the socket 22 includes a bulb socket 23 and a bulb 24. The center of the bulb socket 23 is furnished with a cylindrical hole 34 for plugging a bulb 24; the cylindrical hole 34 is a cross-shaped hole on the bottom thereof, and furnished with four through holes 38, 39, 40 and 41; every through hole is designed to align with the cross-shaped plug stub 37; the cylindrical hole 34 of the bulb socket 23 is to be plugged with a bulb 24.

Each bulb assembly 21 includes a bulb 24 and a bulb socket 23, and then the bulb assembly 21 is mounted in the cylindrical cavity 32 of the socket 22. The bulb 24 of the bulb assembly 21 is furnished with different light emitter, which is connected to the outside with two copper wires 30 and 31. After the bulb 24 and the bulb socket 23 are assembled together, the two copper wires 30 and 31 of the bulb 24 can only be plugged in one set of symmetrical through holes selected; if the copper wires are plugged through the two through holes 38 and 39 as shown in FIGS. 2, 3, 8 and 10, the rest part of the wires will be folded and put on both sides of the plug stub 37. If the copper wires are plugged through the two through holes 40 and 41 as shown in FIGS. 5, 6, 9 and 11, the rest part of the wires will be folded and put on both sides of the plug stub 37.

As shown in FIG. 1, the lamp strings 12 and 13 in the Christmas lamp string 11 are set up separately in accordance with the number of the bulb assemblies 21, the resistance value of each bulb assembly 21 and the shape of the bulb thereof. Generally, if a Christmas lamp string 11 is assembled with a lamp string 12 and a lamp string 13 which are different, the bulb assemblies 21 thereof can not exchanged each other; however; the structure of the present invention can over come the aforesaid problem.

Figure 12:
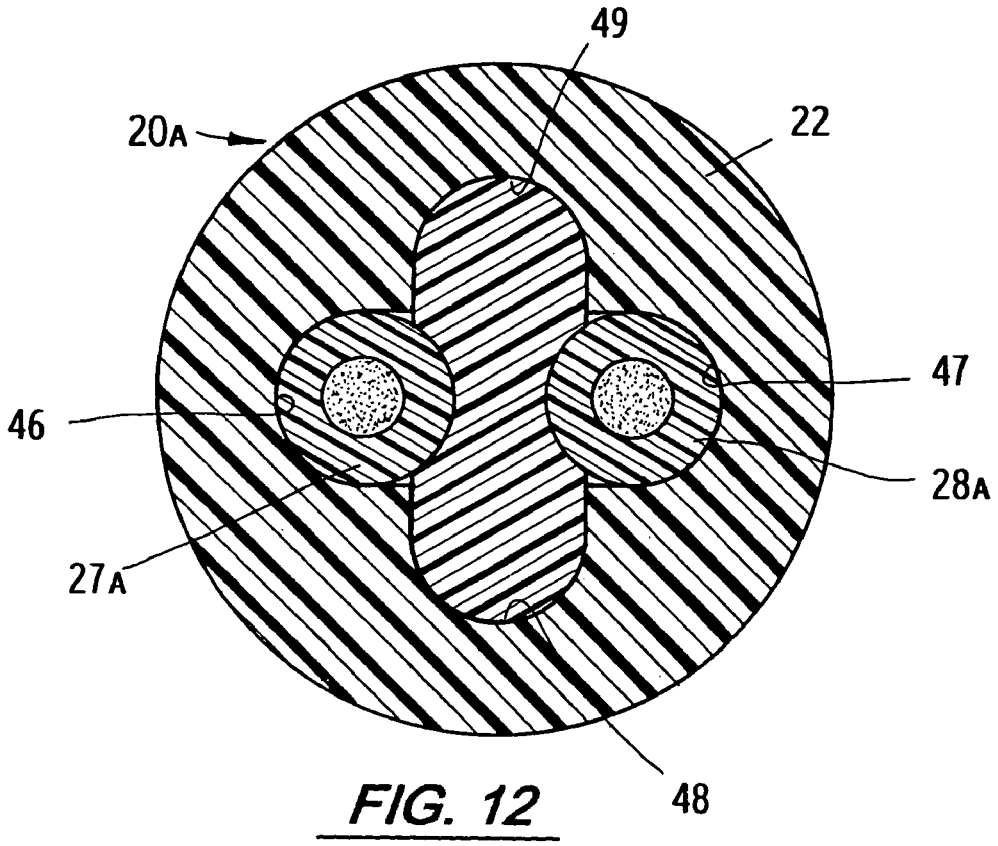
FIG. 12 is a sectional view of the present invention, showing the structure on line 2—2 in FIG. 4 thereof.

As shown in FIGS. 4, 8, 10 and 12, the horizontal level structure is selected, and the two power-supply wires 27A and 28A of the lamp assembly 20A are plugged in the symmetrical power-supply wire grooves 46 and 47 respectively (as shown in FIG. 12) in horizontal level position; the two copper pieces 25A and 26A on the terminals of the two power-supply wires 27A and 28A are plugged in the two horizontal level copper-piece grooves 42 and 43 (as shown in FIG. 10). The rectangular groove 53 and the cylindrical cavity 32 in the socket 22 are used for plugging a bulb assembly 21; the two copper wires 30A and 31A under the bulb 24 pass the horizontal through holes 38 and 39 of the socket 23, while the tail ends thereof are attached to the outer surface of the cross-shaped plug stub 37. After the bulb assembly 21A is plugged in the cylindrical cavity 32 and the rectangular cavity 53 of the socket 22, the bulb assembly 21A and the socket will be guided and limited with the positioning groove 35 of the bulb socket 23 and the positioning flange 33 of the socket 22 to facilitate the bulb assembly 21A and the socket 22 to plug together; then, the two copper wires 30A and 31A of the bulb assembly 21 will be in close contact electrically with the two power-supply wires 27A and 28A laid in horizontal position.

Figure 13:
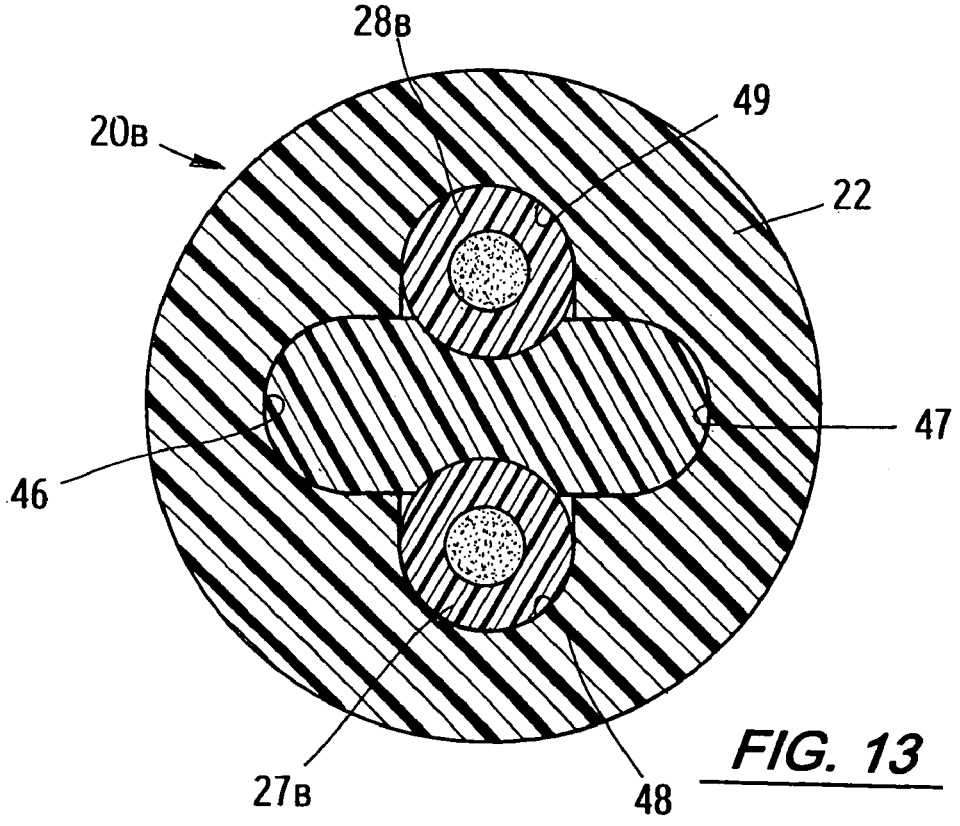
FIG. 13 is a sectional view of the present invention, showing the structure on line 3—3 in FIG. 7 thereof.

As shown in FIGS. 5, 7, 9, 11 and 13, the vertical position structure is shown; the two power-supply wires 27B and 28B of the lamp assembly 20B are plugged vertically in the symmetrical power-supply wire grooves 48 and 49 respectively (as shown in FIG. 13). Two copper pieces 25B and 26B on the terminals of the two power-supply wires 27B and 28B are plugged in the two copper-piece grooves 44 and 45 (as shown in FIG. 11). The rectangular cavity 53 and the cylindrical cavity 32 in the upper part of the socket 22 are to be plugged with a bulb assembly 21; the two copper wires 30B and 31B of the bulb 24 are plugged in two vertical through holes 40 and 41 of the bulb socket 23, while the terminals of the wires are bent and attached to the outer surface of the cross-shaped plug stub 37 respectively. After the bulb assembly 21B is plugged in the cylindrical cavity 32 and the rectangular cavity 53 of the socket 22, the bulb assembly 21B and the socket 22 will be limited and guided by means of the positioning groove 35 of the bulb socket 23 and the positioning flange 33 of the socket 22 so as to have the bulb assembly 21B and the socket 22 assembled together, and to have the two copper wires 30B and 31B and the two vertical power-supply wires 27B and 28B connected electrically.

The two different types of lamp strings 12 and 13 can be used in a Christmas lamp string 11; if some bulb assemblies 21A and 21B are missing in the lamp strings, different types of bulb assembly 21A or 21B may be plugged in the cylindrical cavity 32 and the rectangular groove 53 of a different socket 22; however, if a different type of bulb assembly 21 is plugged in socket 22, the two copper wires 30 and 31 of the bulb assembly 21 would not be in contact electrically with the two copper pieces 25 and 26 respectively, i.e., the electric circuit is always in open condition so as to prevent from a wrong connection taking place.

If a bulb assembly 21 of a socket 22 is plugged in a correct type of lamp assembly 20, the two copper wires 30 and 31 of the bulb assembly 21 will be in close contact with the two copper pieces 25 and 26 respectively; then, the two copper wires 30 and 31 of the bulb assembly 21 will be in contact electrically with the two power-supply wires 27 and 28 of the socket 22 respectively.

The rectangular cavity 53 of the socket 22 in the lamp assembly 20 is furnished with two horizontal copper-piece grooves 42 and 43 and two vertical copper-piece grooves 44 and 45 so as to facilitate two sets of different types of copper pieces 25 and 26 to be plugged therein. Different types of bulb assemblies 21A and 21B can be plugged in the socket 22 in accordance with the horizontal or vertical position of the two copper pieces 25 and 26; then, two different types of lamp strings 12 and 13 can be connected together to provide different types of flash light.

According to the present invention, the bulb assembly 21A in the first lamp string 12 is furnished with regular bulbs; the bulb 24 and the bulb socket 23 of the bulb assembly 21A are plugged in a horizontal position; when the two copper pieces 25A and 26A are plugged in the rectangular cavity 53 of the socket 22, the copper pieces must be plugged in the horizontal copper-piece grooves 42 and 43 respectively; at the same time, the two power-supply wires 27A and 28A must be placed in horizontal position. In the second lamp string 13, the bulb assembly 21B is furnished with twinkle bulbs; the bulb 24 and the bulb socket 23 in the bulb assembly 21B are plugged in a vertical position; when the two copper pieces 25B and 26B are plugged in the rectangular cavity 53 of the socket 22, the copper pieces must be plugged in the vertical copper-piece grooves 44 and 45 respectively; at the same time, the two power-supply wires 27B and 28B must be placed in vertical position. In case of any type of bulb assembly 21A or 21B being dropped or missing, an incorrect bulb might be plugged in, but no danger could be caused because of no power supply being connected.

While the invention has been described with reference to specific embodiments it must be understood that those embodiments are susceptible to many changes, substitutions, and modifications that will be readily apparent to those having ordinary skill in the art without departing from the scope and spirit of the invention.

What is claimed is:

1. A structure for Christmas bulb socket, comprising:

a socket including a cylindrical cavity in upper part thereof; inside of said cylindrical cavity furnished with at least one positioning flange; a rectangular cavity furnished under said cylindrical cavity, and surface of said rectangular cavity furnished with two sets of symmetrical copper-piece grooves; in said two sets of symmetrical copper-piece grooves, only one set thereof mounted with copper pieces;

a bulb assembly including:

a bulb socket, of which a cylindrical body furnished with at least two symmetrical position grooves to be mated with positioning flanges of said cylindrical cavity; lower part of said cylindrical body furnished with a cross-shaped plug stub; top center of said bulb socket furnished with a cylindrical hole for mounting a bulb; bottom of said cylindrical hole furnished with two sets of symmetrical through holes opposite to said cross-shaped plug stub, and said through holes used for laying through two copper wires and said bulb;

a bulb, of which one end furnished with two copper wires to pass through two symmetrical through holes on lower end of said bulb socket, and ends of said copper wires being bent and attached to both sides of said cross-shaped plug stub.

2. A structure of Christmas bulb socket as claimed in claim 1, wherein lower part of said cylindrical cavity is furnished with two sets of symmetrical copper-piece grooves, but only one set thereof used for plugging copper pieces in horizontal position.

3. A structure for Christmas bulb socket as claimed in claim 1, wherein lower part of said cylindrical cavity is furnished with two sets of symmetrical copper-piece grooves, but only one set thereof used for plugging copper pieces in vertical position.

4. A structure for Christmas bulb socket as claimed in claim 1, wherein lower part of said bulb socket of said bulb assembly is furnished with symmetrical cross-shaped plug stubs; two symmetrical through holes furnished between said cross-shaped plug stub and said cylindrical hole; one set of said two copper pieces being designed in horizontal position, and ends of said copper wires being bent and attached to outer surfaces of said plug stub.

5. A structure for Christmas bulb socket as claimed in claim 1, wherein lower part of said bulb socket of said bulb assembly is furnished with symmetrical cross-shaped plug stubs; two symmetrical through holes furnished between said cross-shaped plug stub and said cylindrical hole; one set of said two copper pieces being designed in vertical position, and ends of said copper wires being bent and attached to outer surface of said plug stub.

* * * * *